US011891868B2

(12) United States Patent
Cullum et al.

(10) Patent No.: US 11,891,868 B2
(45) Date of Patent: Feb. 6, 2024

(54) EXTRUSION BALL ACTUATED TELESCOPING LOCK MECHANISM

(71) Applicants: Jason Cullum, League City, TX (US); Andres Sosa, Spring, TX (US)

(72) Inventors: Jason Cullum, League City, TX (US); Andres Sosa, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 17 days.

(21) Appl. No.: 17/538,898

(22) Filed: Nov. 30, 2021

(65) Prior Publication Data

US 2023/0167697 A1 Jun. 1, 2023

(51) Int. Cl.
*E21B 23/04* (2006.01)
*E21B 33/12* (2006.01)

(52) U.S. Cl.
CPC ..... *E21B 23/0413* (2020.05); *E21B 33/12* (2013.01)

(58) Field of Classification Search
CPC ..... E21B 23/0413; E21B 33/12
See application file for complete search history.

(56) References Cited

U.S. PATENT DOCUMENTS 1,883,071 A 10/1932 Frederick
2,409,811 A * 10/1946 Taylor, Jr. ..... E21B 43/10 285/85
3,037,797 A * 6/1962 Brown ..... E21B 43/14 285/82
3,051,244 A * 8/1962 Litchfield ..... E21B 43/10 166/325
3,398,803 A 8/1968 Leutwyler et al.
3,796,260 A 3/1974 Bradley
(Continued)

FOREIGN PATENT DOCUMENTS

CN 202937227 U 5/2013
CN 102979494 B 10/2015
(Continued)

OTHER PUBLICATIONS

"Hydro-Mech Bridge Plug"; Elder Tools International; Retrieved Online from http://www.eldertools.com/index.php/hydro-mech-bridge-plug/ on Mar. 22, 2019; 2 Pages.
(Continued)

*Primary Examiner* — Steven A MacDonald
(74) *Attorney, Agent, or Firm* — CANTOR COLBURN LLP

(57) ABSTRACT

An assembly and a method of performing an operation in a borehole. The assembly includes a plug, and a retrieving head rigidly coupled to the plug in a locked configuration. The retrieving head includes a lock disposed therein comprising a housing, a mandrel, and a ball seat. The ball seat is secured to the housing at a first seat location when the assembly is in the locked configuration. The assembly is conveyed assembly in the borehole. A ball is dropped through the assembly to seat at the ball seat. A fluid pressure created at the ball moves the ball seat to a second seat location within the housing to place the assembly in an unlocked configuration. The mandrel is shifted to allow the retrieving head to move axially in the unlocked configuration.

11 Claims, 18 Drawing Sheets

(56) References Cited

U.S. PATENT DOCUMENTS 4,089,548 A * 5/1978 Gurley ..... E21B 17/06 285/2
4,175,778 A * 11/1979 Nunez ..... E21B 23/06 166/125
4,314,608 A 2/1982 Richardson
4,809,776 A 3/1989 Bradley
4,842,069 A 6/1989 Baugh et al.
5,018,579 A 5/1991 Braddick et al.
5,020,597 A * 6/1991 Braddick ..... E21B 33/16 166/291
5,082,062 A 1/1992 Wood et al.
5,178,219 A 1/1993 Striech et al.
5,375,662 A 12/1994 Echols, III et al.
5,404,955 A 4/1995 Echols, III et al.
5,553,672 A 9/1996 Smith, Jr. et al.
5,692,564 A 12/1997 Brooks
5,722,491 A 3/1998 Sullaway et al.
5,749,419 A 5/1998 Coronado et al.
6,003,607 A * 12/1999 Hagen ..... E21B 43/10 166/120
6,053,250 A 4/2000 Echols
6,167,970 B1 * 1/2001 Stout ..... E21B 23/04 166/182
6,318,470 B1 * 11/2001 Chang ..... E21B 23/0413 175/62
6,408,946 B1 * 6/2002 Marshall ..... E21B 23/04 166/242.6
6,568,474 B2 5/2003 George et al.
6,666,275 B2 12/2003 Neal et al.
6,896,061 B2 5/2005 Hriscu et al.
6,942,039 B2 9/2005 Tinker
7,011,153 B2 * 3/2006 Erkol ..... E21B 23/06 166/383
7,021,389 B2 4/2006 Bishop et al.
7,624,793 B2 12/2009 Freyer et al.
7,950,468 B2 5/2011 Horton
8,186,446 B2 5/2012 Ingram et al.
8,496,052 B2 7/2013 Frazier
8,757,273 B2 6/2014 Themig et al.
9,004,180 B2 4/2015 Jackson
9,200,499 B2 12/2015 Hall et al.
9,243,479 B2 1/2016 Nygardsvoll et al.
9,290,998 B2 3/2016 Radford
9,359,871 B2 6/2016 White et al.
9,464,510 B2 10/2016 Kristoffer
9,512,683 B2 * 12/2016 Akkerman ..... E21B 17/06
9,828,833 B2 11/2017 Hofman et al.
10,502,025 B2 12/2019 Van Petegem et al.
10,822,915 B2 11/2020 Fagna et al.
11,352,853 B2 6/2022 Maddux et al.
2003/0062169 A1 * 4/2003 Marshall ..... E21B 17/06 166/242.7
2003/0168227 A1 * 9/2003 Stoesz ..... E21B 31/005 173/91
2004/0000435 A1 * 1/2004 Nguyen ..... E21B 10/25 175/372
2004/0163820 A1 8/2004 Bishop et al.
2005/0072572 A1 * 4/2005 Churchill ..... E21B 23/006 175/324
2005/0103493 A1 5/2005 Stevens et al.
2005/0133217 A1 6/2005 Erkol
2008/0314591 A1 12/2008 Hales et al.
2009/0242213 A1 10/2009 Braddick
2010/0089583 A1 * 4/2010 Xu ..... E21B 47/13 175/57
2010/0200218 A1 8/2010 Palidwar et al.
2012/0285703 A1 11/2012 Abraham et al.
2014/0034332 A1 2/2014 Allamon et al.
2014/0209327 A1 7/2014 Patel
2014/0246209 A1 * 9/2014 Themig ..... E21B 34/142 166/194
2014/0332231 A1 * 11/2014 Themig ..... E21B 34/14 166/194
2015/0034331 A1 2/2015 Merron
2015/0167424 A1 6/2015 Richards et al.
2015/0376968 A1 12/2015 Flores
2016/0130915 A1 5/2016 Brække et al.
2016/0168938 A1 6/2016 Pray et al.
2016/0326836 A1 * 11/2016 Gonzalez ..... E21B 43/14
2017/0342806 A1 11/2017 Themig et al.
2018/0106127 A1 * 4/2018 Du ..... E21B 33/1285
2019/0040699 A1 * 2/2019 Perez ..... E21B 23/01
2019/0203550 A1 7/2019 Geoffroy
2019/0284898 A1 * 9/2019 Fagna ..... E21B 33/1204
2020/0080397 A1 3/2020 Walker
2020/0149363 A1 * 5/2020 Cho ..... E21B 23/0413
2020/0291730 A1 9/2020 Schultz et al.
2021/0131227 A1 * 5/2021 Gharesi ..... E21B 34/142
2021/0164299 A1 6/2021 Fong et al.
2021/0277735 A1 * 9/2021 Fagna ..... E21B 33/134
2023/0167699 A1 6/2023 Sosa et al.
2023/0167704 A1 6/2023 Cullum et al.
2023/0167706 A1 6/2023 Sosa

FOREIGN PATENT DOCUMENTS

WO 2009116875 A1 9/2009
WO 2015115905 A1 8/2015
WO 2018052308 A1 3/2018
WO 2018140462 A1 8/2018
WO 2020037048 A1 2/2020

OTHER PUBLICATIONS

"People. Products. Performance"; Tryton; Retrieved Online from https://www.trytontoolservices.com/files/4.Catalog%202012%20Final%20wo%20tables-030612-WEB.pdf on Mar. 22, 2019; 83 Pages.

International Search Report and Written Opinion Issued in International Application No. PCT/US2022/050272 dated Mar. 22, 2023; 7 Pages.

International Search Report and Written Opinion Issued in International Application No. PCT/US2022/050263; dated Apr. 4, 2023: 7 pages.

International Search Report and Written Opinion Issued in International Application No. PCT/US2022/050268; dated Mar. 30, 2023; 6 pages.

International Search Report and Written Opinion Issued in International Application No. PCT/US2022/050271; dated Apr. 5, 2023; 6 pages.

* cited by examiner

EXTRUSION BALL ACTUATED TELESCOPING LOCK MECHANISM

BACKGROUND

In the resource recovery and fluid sequestration industries, plugs are often set in a borehole in order to perform downhole operations. In various plug systems, the plug is set via a rotation of the plug once it is at its target location downhole. Setting multiple plugs can require multiple trips downhole, which is both time-consuming and expensive. Attempts to set two or more plugs in a single trip is hindered by rigid connection between plugs. Thus, once a lower plug is set, the plugs above it are prevented from being able to rotate to set itself in the borehole. There is therefore a need to be able to set multiple plugs downhole in a single trip that allows flexibility of rotation between the plugs.

SUMMARY

Disclosed herein is a method of performing an operation in a borehole. An assembly is conveyed in the borehole. The assembly includes a retrieving head rigidly coupled to a plug in a locked configuration. The retrieving head includes a lock disposed therein comprising a housing, a mandrel, and a ball seat. The ball seat is secured to the housing at a first seat location when the assembly is in the locked configuration. A ball is dropped through the assembly to seat at the ball seat, wherein a fluid pressure created at the ball moves the ball seat to a second seat location within the housing to place the assembly in an unlocked configuration. The mandrel is shifted to allow the retrieving head to move axially in the unlocked configuration.

Also disclosed herein is an assembly for performing a downhole operation. The assembly includes a plug, and a retrieving head rigidly coupled to the plug in a locked configuration. The retrieving head includes a lock disposed therein comprising a housing, a mandrel, and a ball seat. The ball seat is secured to the housing at a first seat location when the assembly is in the locked configuration. A ball seated at the ball seat causes a fluid pressure to increase at the ball to move the ball seat within the housing to place the assembly in an unlocked configuration that allows axial motion of the retrieving head. The mandrel is configured to shift within the housing to allow the retrieving head to rotate with respect to the plug in the unlocked configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
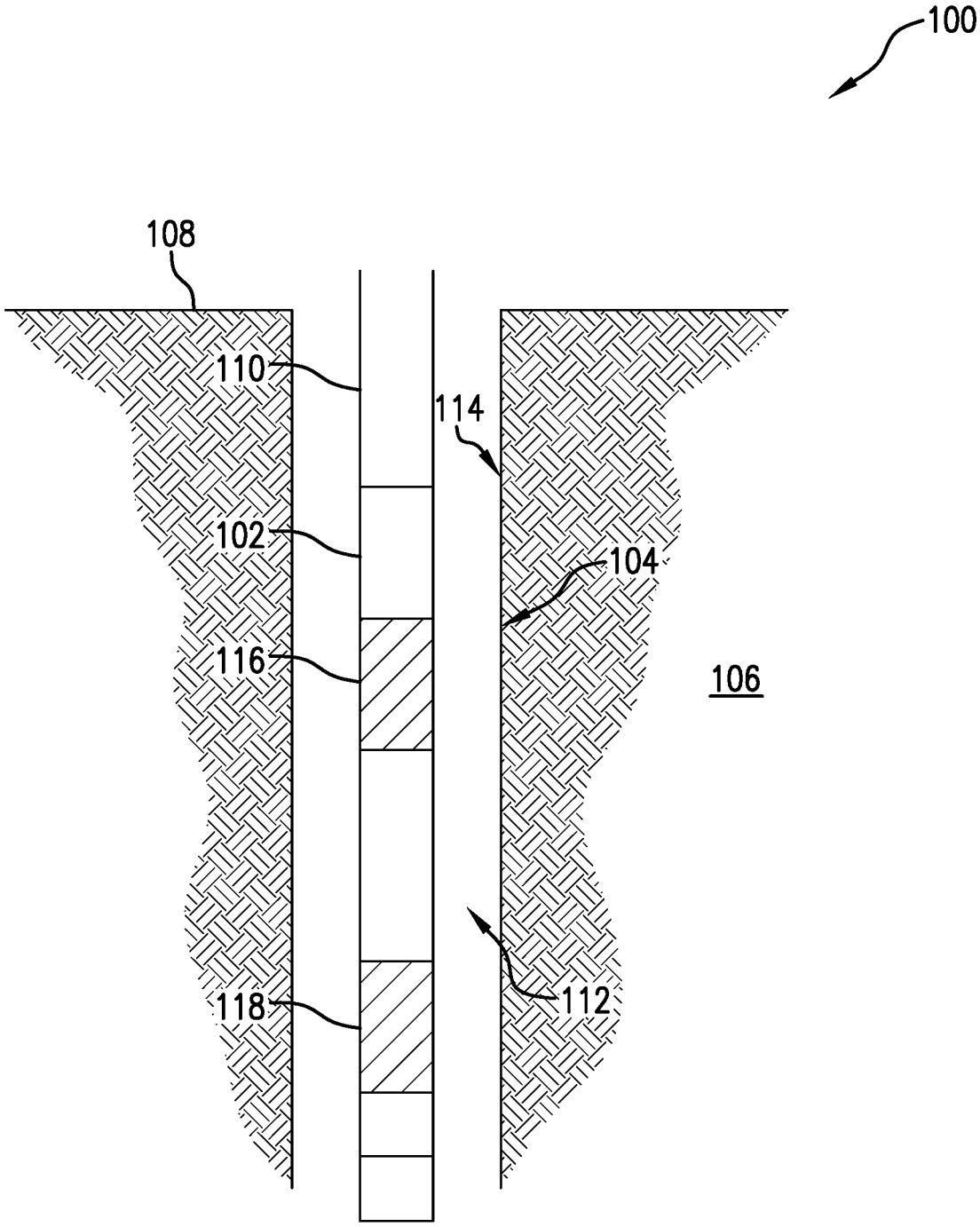
FIG. 1 shows a multi-plug system in an illustrative embodiment.

Referring to FIG. 1, a multi-plug system 100 is disclosed in an illustrative embodiment. The multi-plug system 100 is suitable for use in temporary well containment or fluid sequestration such as $CO_2$ and Hydrogen sequestration. In various embodiments, the multi-plug system is a dual plug system. The multi-plug system 100 includes a string 102 disposed in a borehole 104 formed in a formation 106. The string 102 extends a longitudinal axis. The string 102 can be run into the borehole 104 from a surface location 108 via a running tool 110 or other suitable conveyance device. The string 102 defines an annulus 112 between an exterior surface of the string 102 and a wall 114 of the borehole 104. The string 102 includes at least a first plug assembly 116 at a first location along the string 102 and a second plug assembly 118 at a second location axially separated from the first location. The first plug assembly 116 includes a first plug, and the second plug assembly 118 includes a second plug. The second location is generally downhole from the first location. The string 102 is conveyed to a target location into the borehole 104 with the first plug assembly 116 and the second plug assembly 118 in a locked configuration. In a locked configuration, a selected plug assembly is prevented from moving in a manner that allows its plug to be set and disengaged from a retrieving head. Once at the target location, the second plug assembly 118 is set in the borehole 104. The first plug assembly 116 can be separated from the string 102 and moved to a second location in the borehole 104. The first plug assembly 116 is then unlocked to allow a first plug of the first plug assembly 116 to rotate to set itself in the borehole 104. Once the first plug assembly 116 and the second plug assembly 118 have been set, the running tool 110 can be separated from the string 102 and removed to the surface location 108, leaving the string 102 in the borehole 104.

Figure 2:
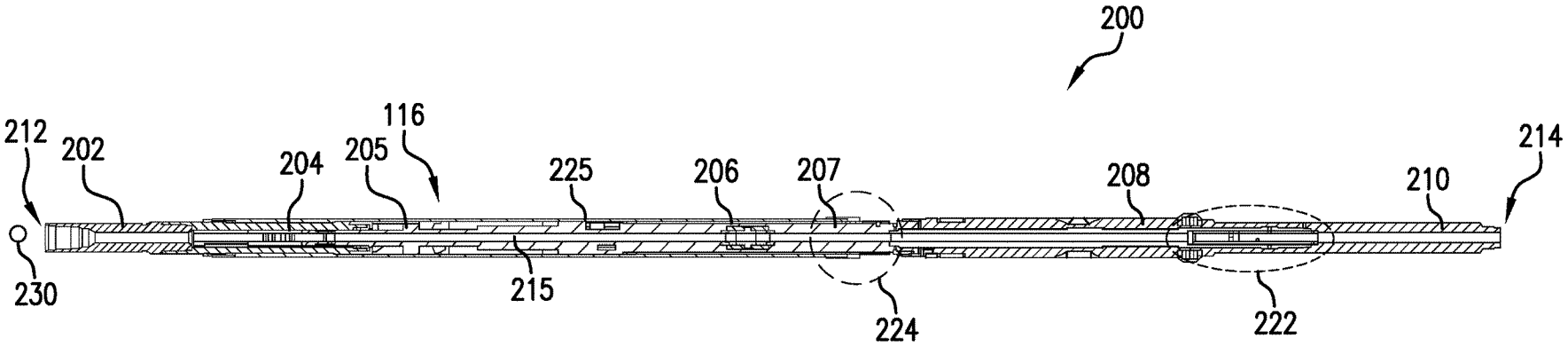
FIG. 2 shows a detailed view of a first plug assembly of a string of the multi-plug system in a locked configuration.

FIG. 2 shows a detailed view 200 of the first plug assembly 116 of the string 102 in a locked configuration. The first plug assembly 116 employs various subassemblies for setting the first plug in the borehole 104 once the second plug (of the second plug assembly 118) has been set. The subassemblies of the first plug assembly 116 include a retrieving head 202, a first lock 204 (or upper lock), a ball valve 206, a plug 208 (i.e., the first plug) and a lower sub 210 that includes a ball catcher. The retrieving head 202 is at a top end 212 or uphole end of first plug assembly 116, while the lower sub 210 is at a bottom end 214 or downhole end of the first plug assembly 116.

The retrieving head 202 is coupled to the top end 205 of the ball valve 206. The first lock 204 is attached to the top end 205 of the ball valve 206. The first lock 204 and the top end 205 of the ball valve 206 are disposed within the retrieving head 202. A bottom end 207 of the ball valve 206 is coupled to a top end of the plug 208. Actuation of the ball valve 206 (i.e., opening and/or closing the ball valve 206) is affected by a limited rotation of a top end 205 of the ball valve 206 and the bottom end 207 of the ball valve, the bottom end 207 including a bottom sub (see bottom sub 1302 of FIG. 13). A bottom end of the plug 208 is coupled to a top end of the lower sub 210. When the subassemblies are coupled together, a bore 215 extends continuously through each of subassemblies of the first plug assembly 116 along the longitudinal axis of the string 102. The first lock 204 is disposed within the retrieving head 202 and the second lock 222 (or lower lock) is disposed within the plug 208. The first lock 204 and the second lock 222 are used to control a setting procedure for the plug 208.

The first lock 204 and the second lock 222 can each be in either a locked configuration or an unlocked configuration. When the first lock 204 is in a locked configuration, the sub-assemblies of first plug assembly 116 are rigidly connected to each other. The plug assembly as a whole can be rotated within the borehole. When the first lock 204 is in an unlocked configuration, the retrieving head 202 is free to move axially with respect to the ball valve 206. When the second lock 222 is in a locked configuration, a mandrel of the plug 208 and a wall-engaging component of the plug 208 are rigidly connected to each other and can be rotated as a unit. When the second lock 222 is in an unlocked configuration, the mandrel of the plug 208 and the wall-engaging component of the plug 208 are in a configuration that allows them to rotate independently of each other.

The first plug assembly 116 is conveyed into the borehole with the first lock 204 and the second lock 222 both in the locked configuration. A ball 230 is dropped into the string 102 from the surface location 108 and is allowed to fall through the bore 215. When the ball lands at the first lock 204, an increase of a first fluid pressure behind the ball 230 cause the first lock 204 to release (i.e., move from a locked configuration to an unlocked configuration). As the ball 230 lands at the plug 208, an increase of a second fluid pressure behind the ball 230 causes the second lock 222 to release (i.e., move from a locked configuration to an unlocked configuration).

The ball 230 is made of an elastically deformable material. Thus, the ball 230 can be deformed or be compressed from its original (or unstressed) shape by applying a compressive force to it. Once the compressive force is removed, the ball 230 returns to its original shape. The ball 230 experiences elastic deformation as it activates the first lock 204 and the second lock 222. The amount of compressive deformation applied on the ball 230 as it traverses the first lock 204 and the second lock 222 is within a range of elasticity of the ball 230.

The ball valve 206 includes a clutch mechanism 224 on its outer surface. The clutch mechanism 224 can be engaged by applying a set down force via the retrieving head 202. Removing the set down force disengages the clutch. In the disengaged state, the clutch is free to rotate separately from the ball valve 206. The ball valve 206 is connected to the mandrel of the plug 208 and the wall-engaging component of the plug 208. When the clutch is in the disengaged position, the lower end of the ball valve 206 and attached mandrel of the plug 208 are free to rotate with respect to the wall-engaged component of the plug 208. When the clutch mechanism 224 is engaged, the bottom end 207 of the ball valve 206 becomes rigidly coupled to the wall-engaging component of the plug 208. Thus, the clutch mechanism 224 can be engaged to allow a torque to be applied at the ball valve 206, mandrel and wall-engaging component. The top end 205 of the ball valve 206 can be rotated with respect to the bottom end 207 of the ball valve 206, thereby effecting actuation of the ball valve 206.

Figure 3:
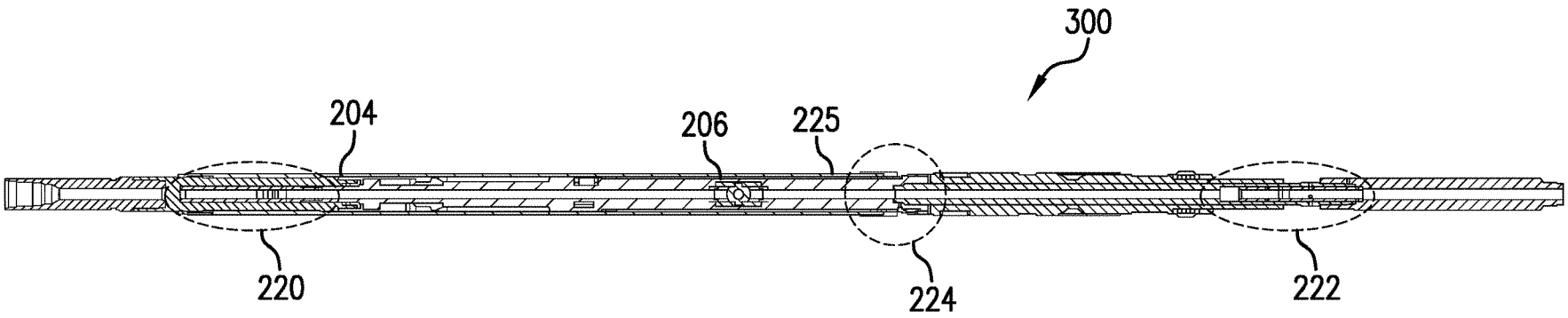
FIG. 3 shows a detailed view of the first plug assembly with a plug in a set configuration.

FIG. 3 shows a detailed view 300 of the first plug assembly 116 with the plug 208 in a set configuration. The first lock 204 and the second lock 222 are in an unlocked configuration. The plug 208 has been set by rotating the string 102 about the longitudinal axis. Once the plug 208 is set, the clutch mechanism 224 is activated to allow the ball valve 206 rotate with respect to the plug 208. Rotating the ball valve 206 moves the ball valve 206 between a closed position and an open position.

The retrieving head 202 includes a sleeve 225 that extends axially over a portion of the ball valve 206. When the first lock 204 is in an unlocked configuration, the retrieving head 202 is free to move axially with respect to the ball valve 206. The clutch mechanism 224 can then be engaged or coupled to the ball valve 206 by moving the retrieving head 202 axially with respect to the ball valve 206 to push the sleeve 225 against the clutch mechanism 224. When the clutch mechanism 224 is engaged, the bottom end 207 of the ball valve 206, the mandrel of the plug and the wall-engaging components of the plug are rigidly coupled together. The clutch mechanism 224, the bottom end 207 of the ball valve 206, the mandrel of the plug and the wall-engaging components of the plug are therefore rotationally stationary in the borehole as the plug 208 is set in the borehole. The top end 205 of the ball valve 206 remains free to rotate when the clutch mechanism 224 is engaged.

Figure 4:
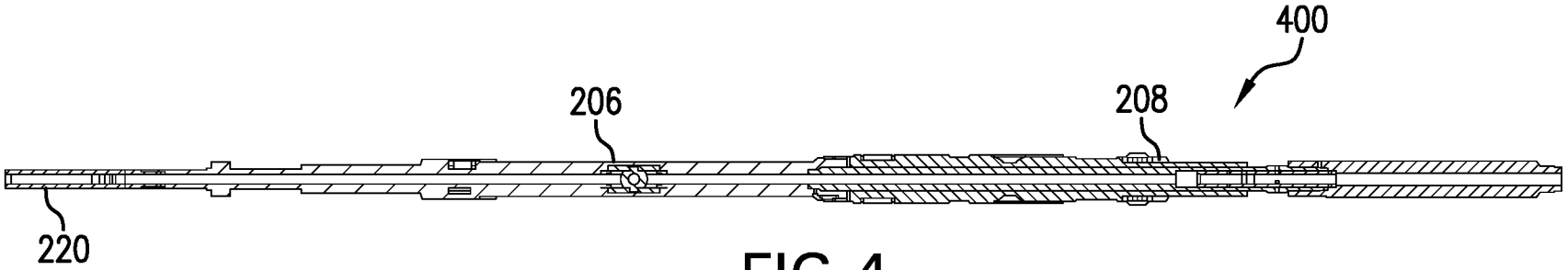
FIG. 4 shows a detailed view of the plug once a running tool has been retrieved to the surface location.

FIG. 4 shows a detailed view 400 of the plug 208 once the running tool 110 has been retrieved to the surface location 108. The retrieving head 202 has been separated from the ball valve 206 and returns to the surface location 108 with the running tool 110. As shown in FIG. 4, the first lock 204, ball valve 206, plug 208 and lower sub 210 remain in the borehole.

Figure 5A:
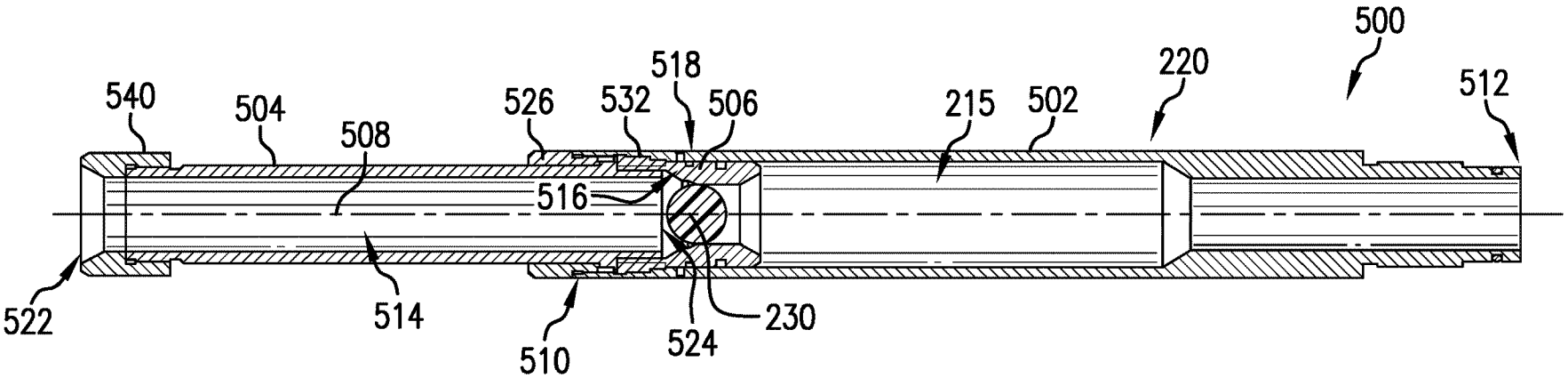
FIG. 5A shows a detailed view of a first lock of a plug assembly in the locked configuration.
Figure 5B:
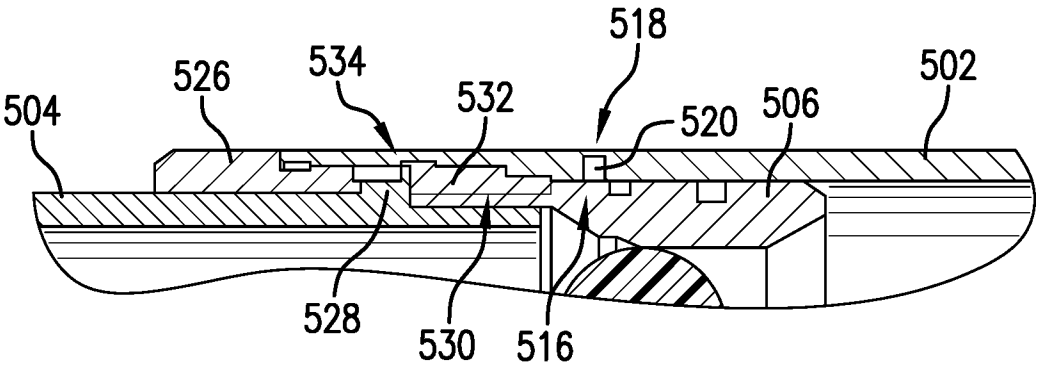
FIG. 5B shows a closeup view of the first lock in the locked configuration.

FIGS. 5A and 5B shows the first lock 204 in a locked configuration, in an illustrative embodiment. FIG. 5A shows a detailed view 500 of the first lock 204 in the locked configuration, while FIG. 5B shows a closeup view of the first lock 204 in the locked configuration. The first lock 204 includes a lock housing 502, a lock mandrel 504 and a ball seat 506. The lock housing 502 is a tubular member extending along a longitudinal axis 508 from a first housing end 510 to a second housing end 512. The bore 215 of the first plug assembly 116 extends through the lock housing 502 along the longitudinal axis 508. The lock mandrel 504 is a tubular member having a flow passage 514 therethrough. The lock mandrel 504 fits within the bore 215 and is able to move within the bore 215 along the longitudinal axis 508. In an embodiment, the lock mandrel 504 includes a cap 540 at the first mandrel end 522. The ball seat 506 is disposed in the bore 215 and is able to move within the bore 215.

A shear member 520 secures the ball seat 506 within the lock housing 502 at a first location. The shear member 520 can be a shear pin or shear screw or other shear device, in various embodiments. In an embodiment, the ball seat 506 include a first hole 516 on its outer surface. A second hole 518 is located on an interior surface of the lock housing 502. In the locked configuration, the ball seat 506 is secured at a first location in the lock housing 502 at which the first hole 516 and the second hole 518 are axially aligned. The shear member 520 resides within the first hole 516 and the second hole 518 to secure the ball seat 506 within the lock housing 502 at the first location.

The lock mandrel 504 extends along the longitudinal axis 508 from a first mandrel end 522 to a second mandrel end 524. In the locked configuration, the ball seat 506 is at a first seat location and the lock mandrel is at a first mandrel location. At the first mandrel location, the second mandrel end 524 is disposed within the bore 215 of the lock housing 502 at the first housing end 510 with the remainder of the lock mandrel 504 residing outside of the bore 215. A retainer 526 is coupled to the first housing end 510 and traps the second mandrel end 524 within the bore 215. The second mandrel end 524 includes a ridge 528 on its outer surface. In the locked configuration, the ridge 528 is seated at a receiving portion 530 of the ball seat 506. The retainer 526 and the receiving portion 530 of the ball seat 506 reside on opposite sides of the ridge 528 and maintain the ridge 528 and, by extension, the lock mandrel 504 in a stationary position with respect to the lock housing 502. A snap ring 532 is wrapped around the exterior surface of the receiving portion 530 of the ball seat 506 while the first lock 204 is in the locked configuration. The snap ring 532 resides partially in a groove 534 formed in an inner surface of the lock housing 502. A portion of the snap ring 532 lies against the ridge 528 of the lock mandrel 504 to prevent axial motion of the lock mandrel 504.

As shown in Figure SA, the ball 230 has been dropped into the first lock 204 and, upon being seated at the ball seat 506, forms an interference fit with the ball seat 506, thereby creating an obstruction that blocks the flow of fluid in the bore 215. The obstruction causes an increase in a fluid pressure on the ball 230 and the ball seat 506. Once the fluid pressure reaches or exceeds a pressure threshold, the shear member 520 separates or is ruptured, allowing the ball seat 506 to be pushed in the direction of the second housing end 512 via the fluid pressure.

Figure 6:
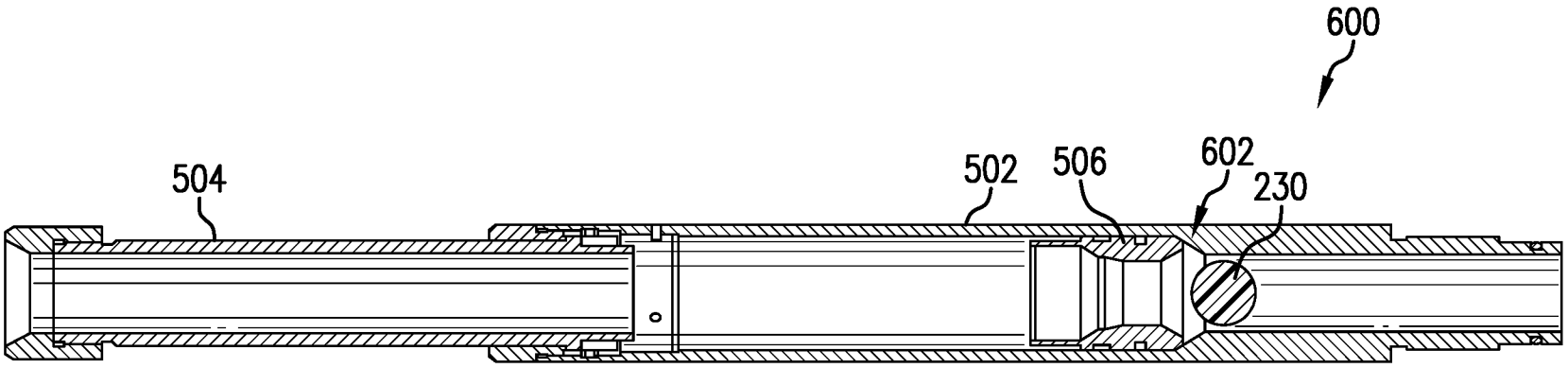
FIG. 6 shows the first lock in an unlocked and unshifted configuration.

FIG. 6 shows the first lock 204 in an unlocked and unshifted configuration 600. The ball seat 506 has moved in the direction of the second housing end 512 to settle at a second seat location at an obstruction in the bore 215, such as a ledge 602. Once the ball seat 506 has stopped at the ledge 602, the fluid pressure builds up on the ball 230 to push the ball 230 through the ball seat 506. The ball 230 is compressed as it passes through the ball seat 506 and expands back to its original shape after it passes through the ball seat 506 and proceeds downhole. With the ball seat 506 moved away from the first seat location, the snap ring 532 collapses radially inward and out of the groove 534, freeing the lock mandrel 504 for movement within the lock housing 502. In the unlocked and unshifted configuration, the retrieving head 202 is free to move axially relative to the ball valve 206.

Figure 7:
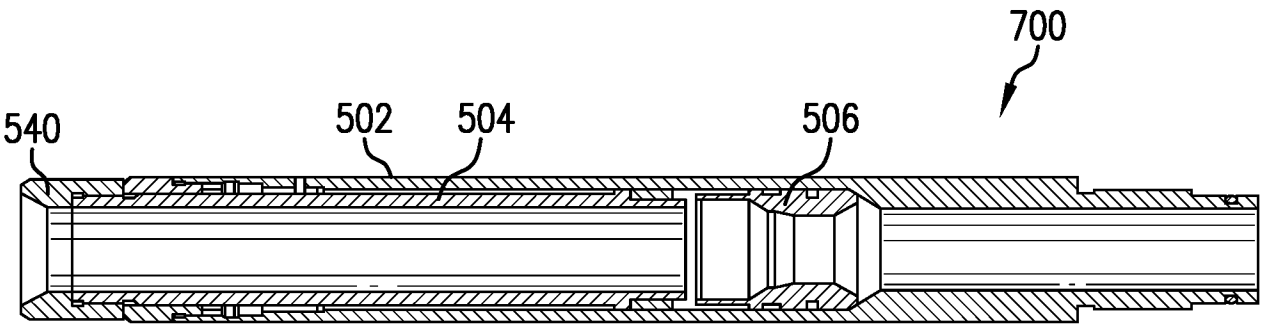
FIG. 7 shows the first lock in an unlocked and shifted configuration.

FIG. 7 shows the first lock 204 in an unlocked and shifted configuration 700. As the retrieving head 202 moves axially, the lock mandrel 504 shifts from the first mandrel location to a second mandrel location proximate second seat location of the ball seat 506 at the ledge 602. The cap 540 limits an axial motion of the lock mandrel 504 into the bore 215.

Figure 8A:
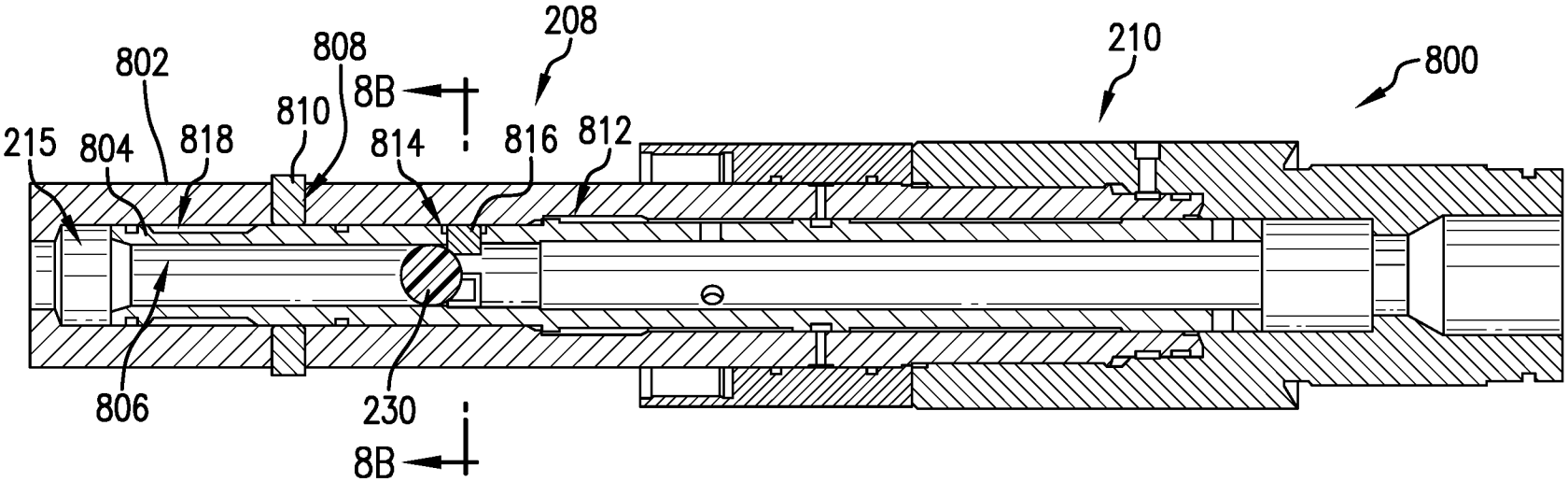
FIG. 8A shows a detailed longitudinal cross-sectional view of a second lock of the plug in a locked configuration.

FIG. 8A shows a detailed longitudinal cross-sectional view 800 of the plug 208 in a locked configuration. The plug 208 includes an outer sleeve 802 defining the bore 215 and an inner sleeve 804 disposed within the bore 215. The inner sleeve 804 defines a flow passage 806 therethrough. The outer sleeve 802 includes a key slot 808 that extends radially through the body of the outer sleeve 802. A key 810 is disposed in the key slot 808. The outer sleeve 802 includes a profile 812 having a second inner diameter greater than a first inner diameter of the outer sleeve 802. The plug 208 is maintained in the locked configuration via a shear member between the outer sleeve 802 and the inner sleeve 804.

The inner sleeve 804 includes a dog slot 814 extending radially through the body of the inner sleeve 804. A seat member such as a dog 816 is disposed in the dog slot 814. An outer surface of the inner sleeve 804 includes a recess 818. The inner sleeve 804 has a first outer diameter and the recess 818 has a second outer diameter that is less than the first outer diameter. The recess 818 extends around the circumference of the inner sleeve 804. When the key slot 808 is not axially aligned with the recess 818 of the inner sleeve 804, the outer surface of the inner sleeve 804 prevents the key 810 from collapsing radially inward. When the dog slot 814 is not axially aligned with the profile 812, the inner surface of the outer sleeve 802 prevents outward motion of the dog 816 out of the dog slot 814. The inner sleeve 804 can move within the outer sleeve 802 to place the key slot 808 in axial alignment with the recess 818 and the dog slot 814 in axial alignment with the profile 812.

Figure 8B:
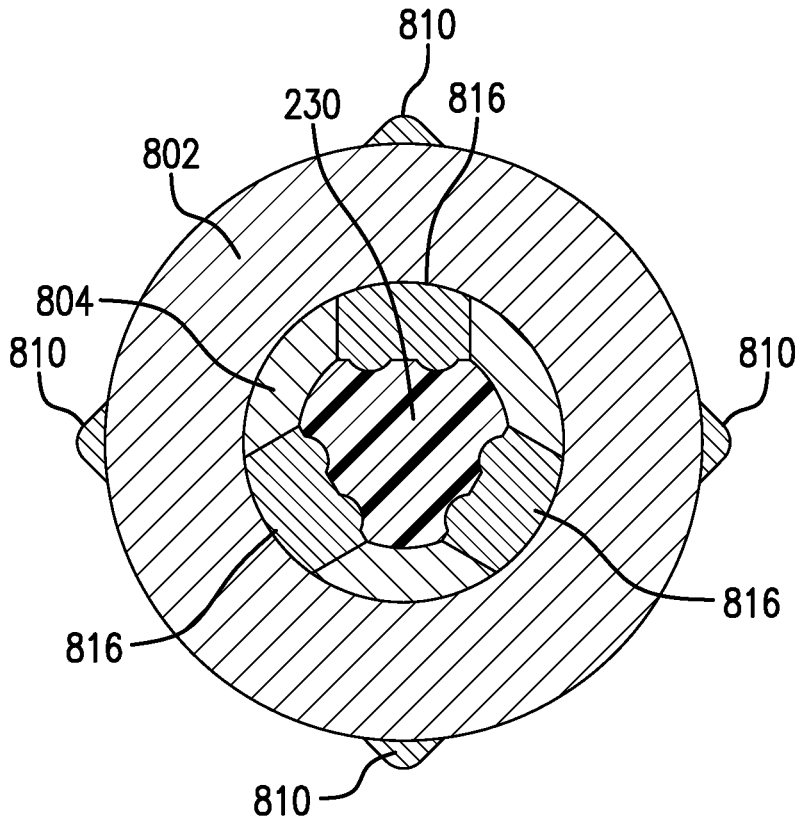
FIG. 8B shows an axial cross section of the second lock at an axial cut A-A in FIG. 8A, with the plug in the locked configuration.

FIG. 8B shows an axial cross section of the plug 208 at the axial cut A-A in FIG. 8A, with the plug 208 in the locked configuration. As shown in FIG. 8B, the key slot 808 can be one of a plurality of key slots at the same axial location of the outer sleeve 802, with each of the plurality of key slots having a key therein. The keys 810 are located within the outer sleeve 802. The dogs 816 are located within the inner sleeve 804 with a portion of the dogs 816 extending radially inward from the inner sleeve 804 into the flow passage 806, blocking the progress of the ball 230 within the flow passage 806.

Referring back to FIG. 8A, the plug 208 is in a locked configuration. The inner sleeve 804 is in a first position or initial position with respect to the outer sleeve 802. In the first position, the key slot 808 is axially unaligned with the recess 818 of the inner sleeve and the dog slot 814 is axially unaligned with the profile 812 of the outer sleeve. Thus, the dog 816 protrudes into the flow passage 806. A ball 230 is dropped into the inner sleeve 804 and is seated at the dog 816. As the ball 230 sits at the dog 816 and is obstructed from further motion through the flow passage 806, it forms an interference fit with the inner sleeve 804. A fluid pressure builds up at the uphole end of the ball 230.

Figure 9:
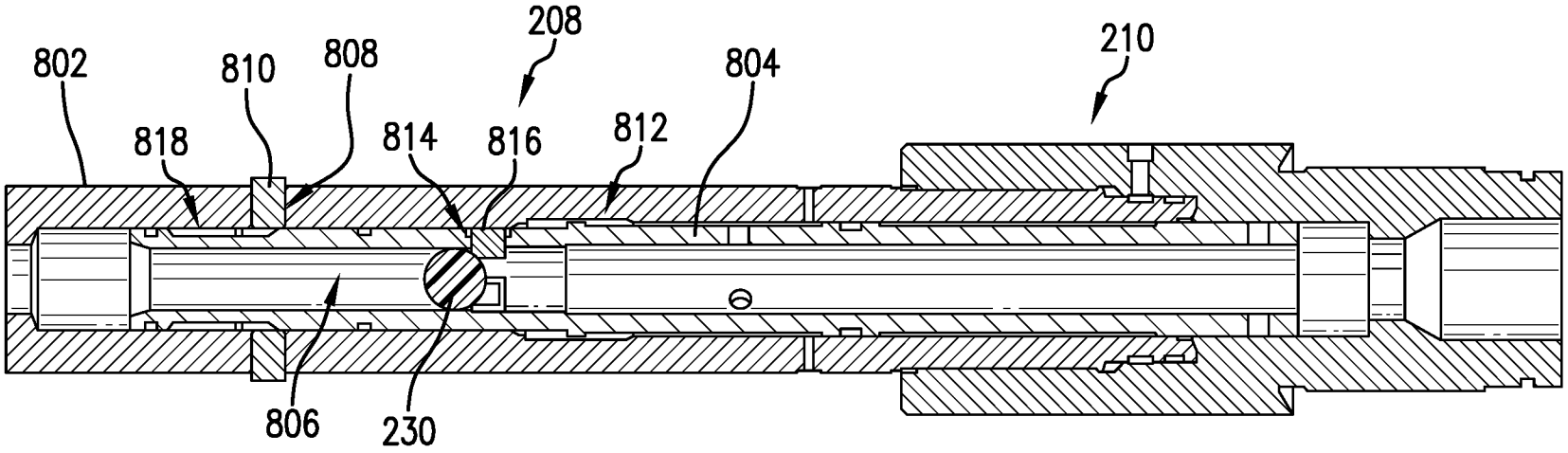
FIG. 9 shows an initial motion of an inner sleeve with respect to an outer sleeve due to the fluid pressure on a ball.

FIG. 9 shows an initial motion of inner sleeve 804 with respect to the outer sleeve 802 due to the fluid pressure on the ball 230. As shown in FIG. 9, as the fluid pressure increases, an axial force on the ball 230 is transmitted to the inner sleeve 804 via the dogs 816, thereby shearing the shear member and moving the inner sleeve 804 axially downhole, or toward a second position or a final position, with respect to the outer sleeve 802.

Figure 10:
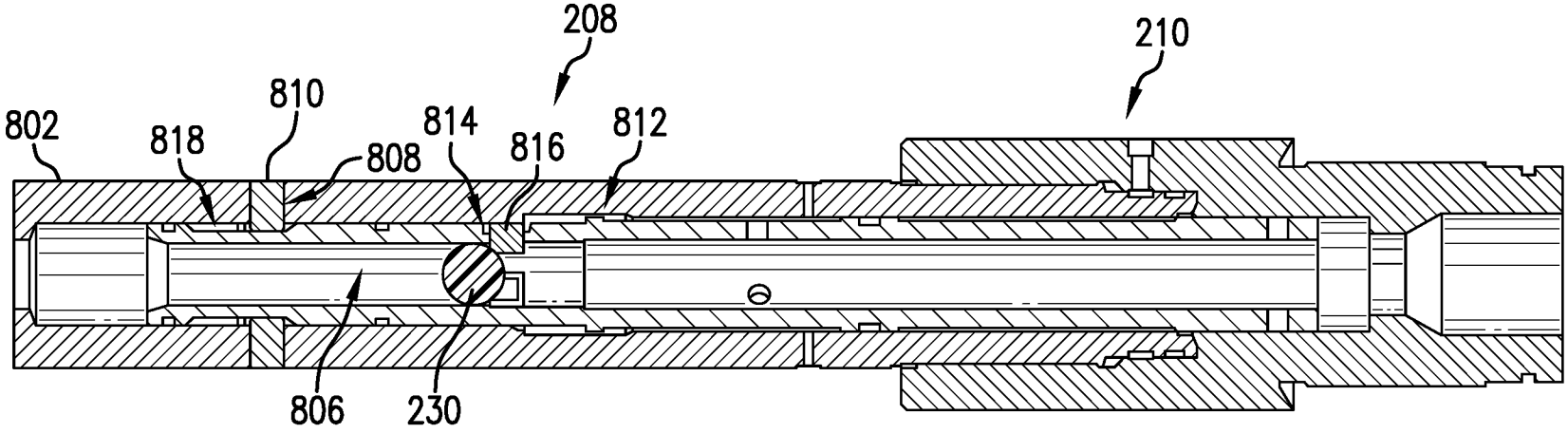
FIG. 10 shows the inner sleeve in an intermediate position with respect to the outer sleeve.

FIG. 10 shows the inner sleeve 804 in an intermediate position with respect to the outer sleeve 802. The key slot 808 of the outer sleeve 802 has moved into alignment with the recess 818 of the inner sleeve 804. The inner sleeve 804 releases the key 810, allowing the key 810 to move radially inward into the recess 818. With the key 810 in the recess 818, an external force can be applied to engage or disengage the plug 208.

Figure 11A:
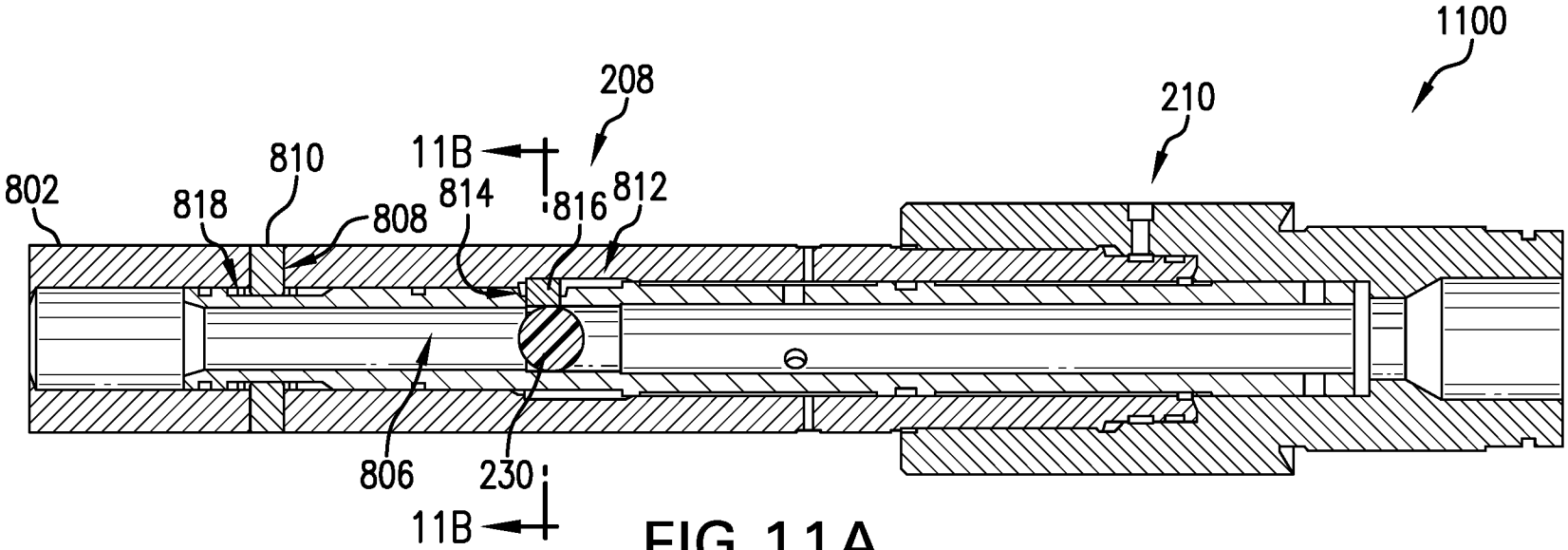
FIG. 11A shows a longitudinal cross-section of the inner sleeve in an unlocked position.

FIG. 11A shows a longitudinal cross-section 1100 of the inner sleeve 804 in the second (unlocked) position. The inner sleeve 804 moves from the intermediate position to the second position with the key 810 within extended into the recess 818. Once in the second position, the dog slot 814 is axially aligned with the profile 812. The fluid pressure pushes the ball 230 downhole, thereby transmitting a radial force on the dog 816 to move the dog 816 radially outward and into the profile 812.

Figure 11B:
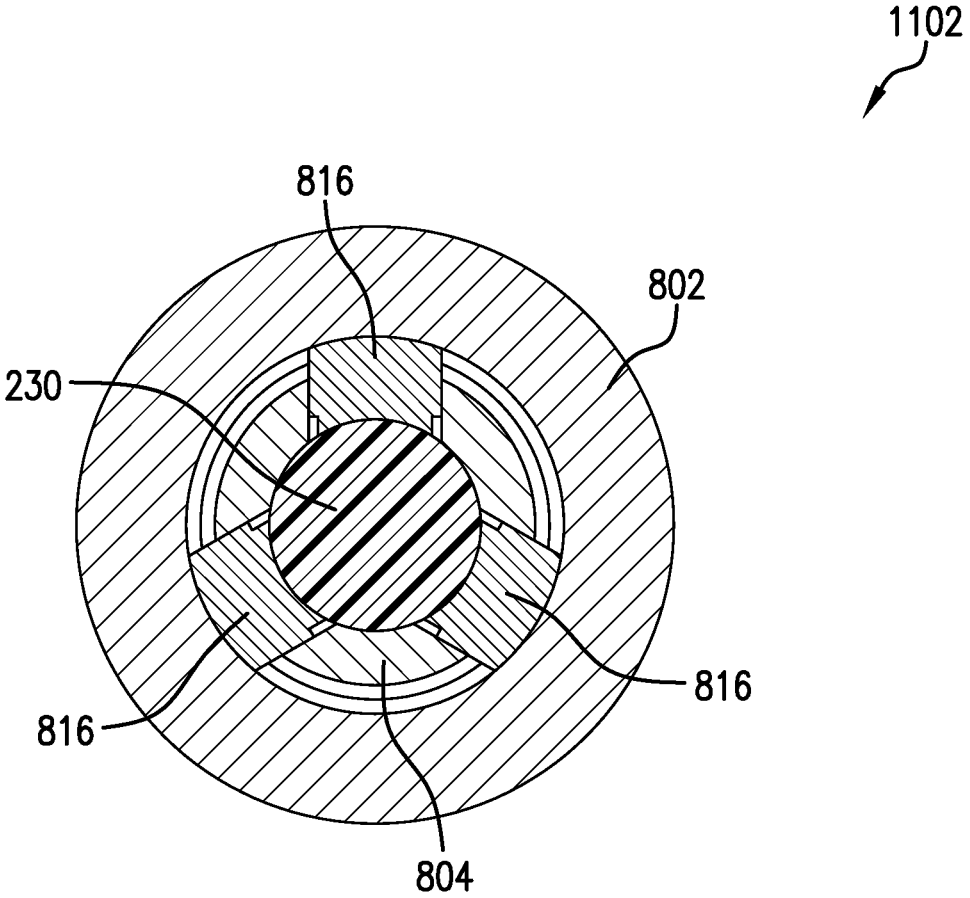
FIG. 11B shows an axial cross section of the second lock at an axial cut B-B shown in FIG. 11A.

FIG. 11B shows an axial cross section 1102 of the plug 208 at the axial cut B-B shown in FIG. 11A. As shown in FIG. 11B, the dogs 816 have moved radially outward out of the flow passage 806. The ball 230 is free to move downhole through the rest of the flow passage 806.

Figure 12:
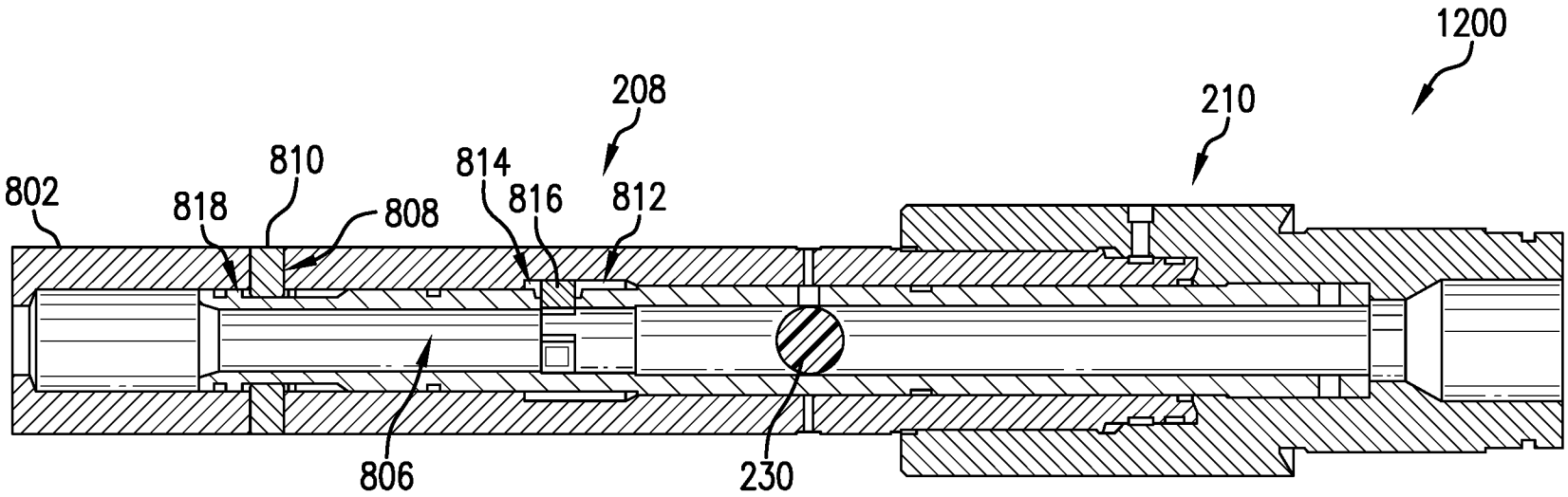
FIG. 12 shows a longitudinal cross section of the inner sleeve and the outer sleeve at the location of a dog slot when the inner sleeve is in the unlocked position.

FIG. 12 shows a longitudinal cross section 1200 of the inner sleeve 804 and the outer sleeve 802 at the location of the dog slot 814 when the inner sleeve 804 is in the second position. With the dogs 816 radially extended, the flow passage 806 is open to allow the ball 230 to progress to the lower sub 210 where it is collected in a ball catcher.

Figure 13:
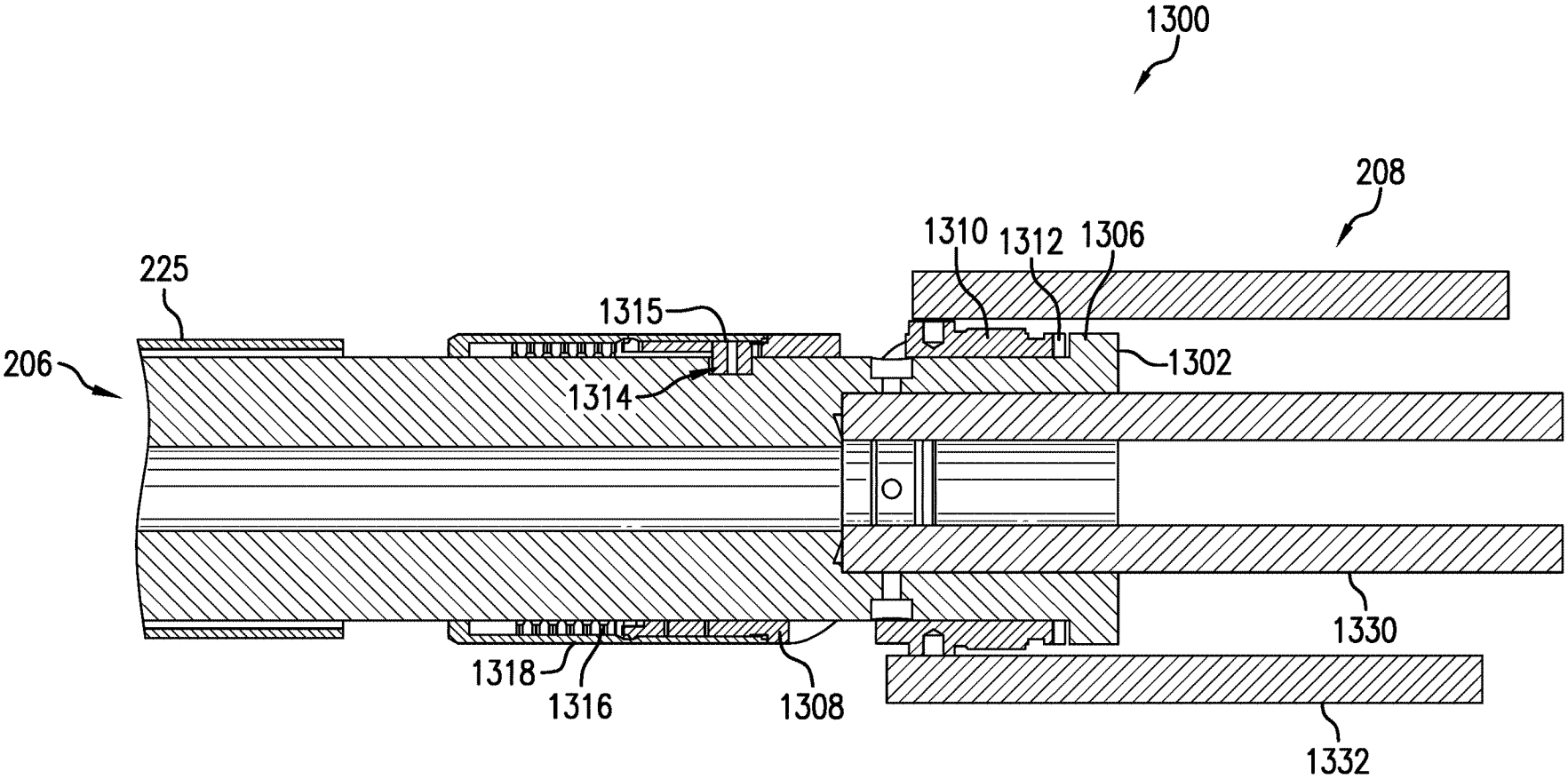
FIG. 13 shows a detailed view of a clutch mechanism of a plug assembly in an unengaged state.

FIG. 13 shows a detailed view 1300 of the clutch mechanism 224 of a plug assembly (e.g., the first plug assembly 116) in an unengaged state. The clutch mechanism 224 is disposed at a bottom sub 1302 of the ball valve 206. The bottom sub 1302 includes a flanged end 1306 at its downhole end. The bottom sub 1302 is rigidly coupled to a plug mandrel 1330 of the plug 208. A torque lock nut 1310 is disposed at the flanged end 1306 around the outer surface of the bottom sub 1302. A bearing 1312 is located between the flanged end 1306 and the torque lock nut 1310 to facilitate rotation between the bottom sub 1302 and the torque lock nut 1310. The torque lock nut 1310 is coupled to a wall-engaging component 1332 of the plug 208, which engages with a wall of the borehole. In the set configuration of the plug 208, the torque lock nut 1310 and wall-engaging component 1332 part are rotationally stationary within the borehole, while the torque clutch 1308, bottom sub 1302 and plug mandrel 1330 are free to rotate with respect to the torque lock nut 1310.

A torque clutch 1308 is disposed around an outer surface of the bottom sub 1302 uphole of the torque lock nut 1310. The torque clutch 1308 is biased away from the flanged end 1306. A key 1315 extends through the torque clutch 1308 and into a hole 1314 in the outer surface of the bottom sub 1302 to keep the torque clutch 1308 rotationally locked to the bottom sub 1302. In various embodiments, a spring 1316 can be used to bias a spring retainer 1318 of the torque clutch 1308 away from the flanged end 1306. The sleeve 225 is shown uphole of the torque clutch 1308.

Figure 14:
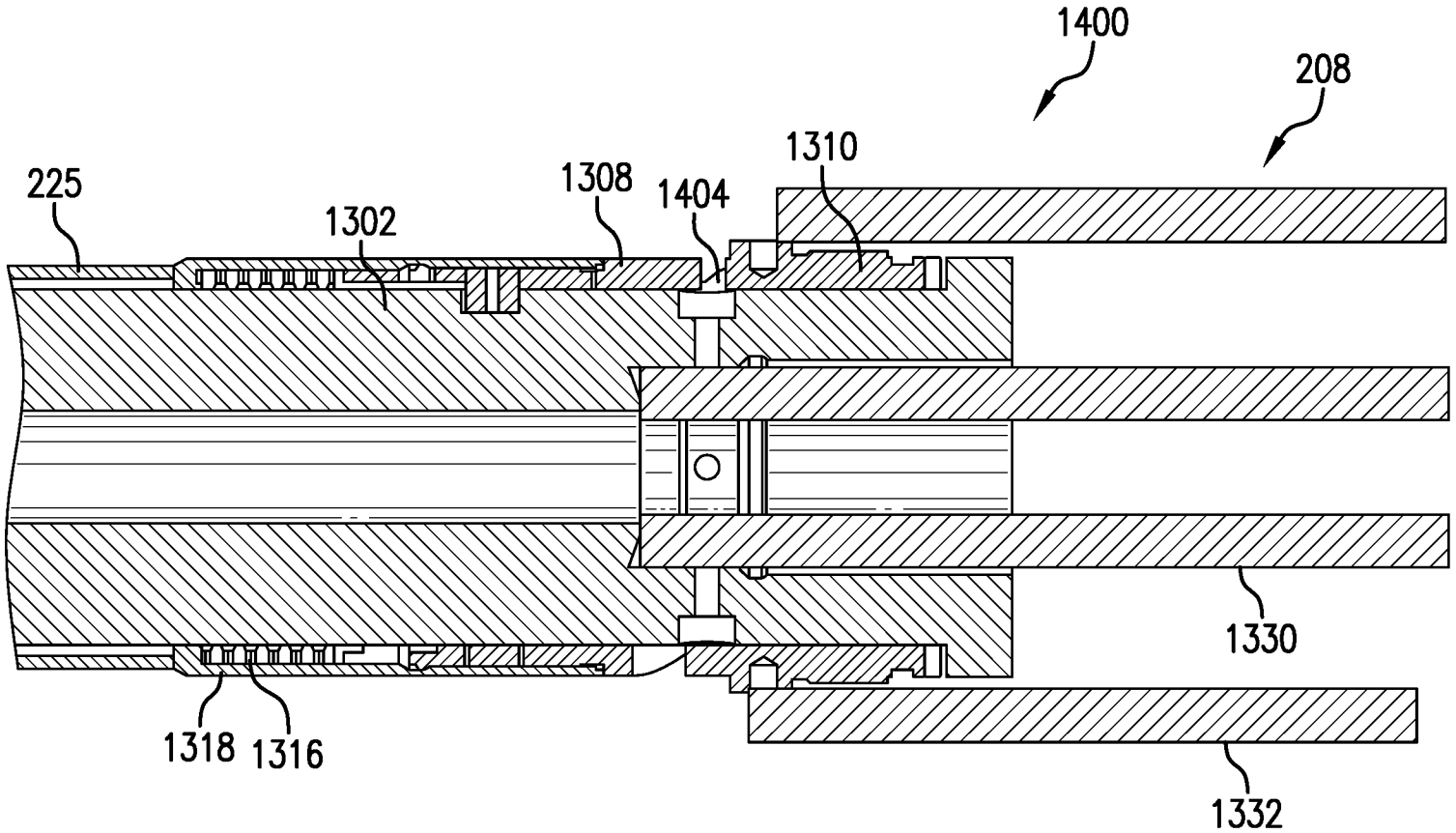
FIG. 14 shows a view of the clutch mechanism in an engaged state.

FIG. 14 shows a view 1400 of the clutch mechanism 224 in an engaged state. The sleeve 225 has moved axially against the spring retainer 1318, thereby compressing the spring 1316. Under the compressive force, the torque clutch 1308 is pushed axially against the torque lock nut 1310, causing the torque lock nut 1310 to couple to the bottom sub 1302. With the torque lock nut 1310 coupled to the bottom sub 1302, the retrieving head 202 can be rotated to produce a rotation of the top end 205 of the ball valve 206, with torque transmitted through the ball valve 206 via the torque clutch 1308 and the torque lock nut 1310. Rotating the ball valve 206 moves the ball valve 206 between a closed configuration and an open configuration.

Figure 15:
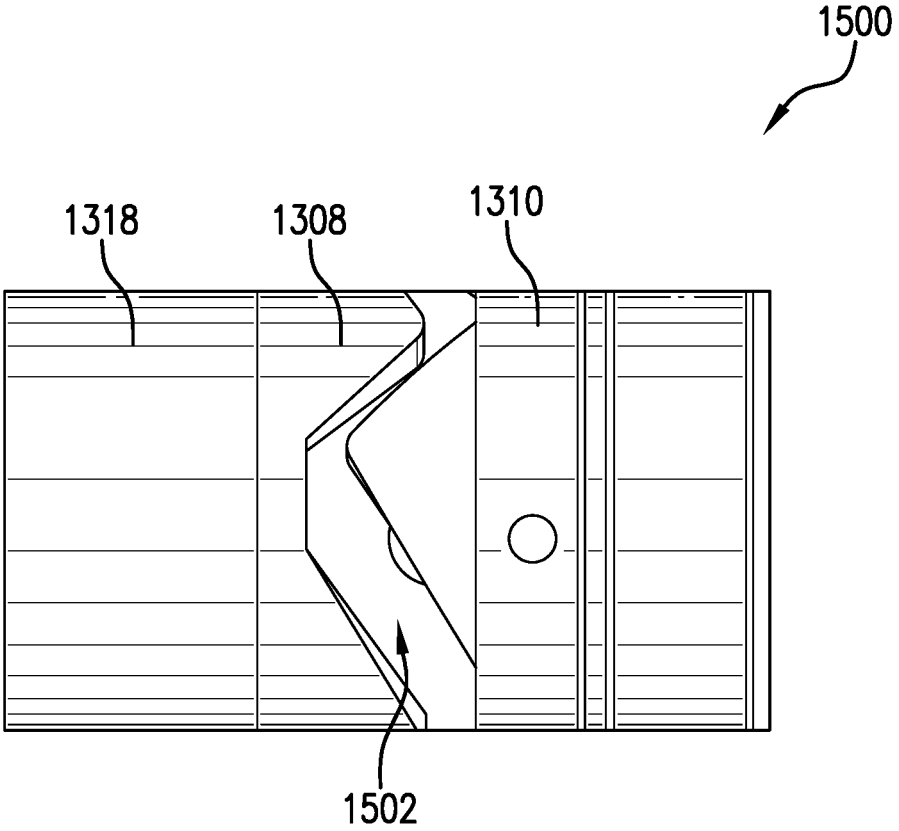
FIG. 15 shows a detailed view of a torque lock nut, in an illustrative embodiment.

FIG. 15 shows a detailed view 1500 of the torque lock nut 1310, in an illustrative embodiment. The torque clutch 1308 and the torque lock nut 1310 are separated by a gap 1502. When an axial force is applied at the torque clutch 1308, the torque clutch 1308 moves axially downward along the ball valve to engage the torque lock nut 1310, thereby closing the gap 1502 and causing the torque lock nut 1310 to rigidly couple to the bottom sub 1302. Thus, retrieving head 202, torque clutch 1308, torque lock nut 1310, bottom sub 1302, plug mandrel 1330, and wall-engaging component 1332 are rigidly coupled to each other. Therefore, in the engaged state, rotating the retrieving head 202 creates a torque on the bottom sub 1302 through to the wall-engaging component.

Once the torque clutch 1308 is disengaged from the torque lock nut 1310, the bottom sub 1302 is free to rotate independently of the torque lock nut 1310. With the ball valve 206 in either of the closed or open configuration, the torque clutch 1308 can be axially reengaged to the torque lock nut 1310 to allow torque against the bottom sub 1302, thereby allowing the closed or open configuration of the ball valve.

Set forth below are some embodiments of the foregoing disclosure:

Embodiment 1. A method of performing an operation in a borehole. The method includes conveying an assembly in the borehole, the assembly including a retrieving head rigidly coupled to a plug in a locked configuration, the retrieving head including a lock disposed therein comprising a housing, a mandrel, and a ball seat, wherein the ball seat is secured to the housing at a first seat location when the assembly is in the locked configuration, dropping a ball through the assembly to seat at the ball seat, wherein a fluid pressure created at the ball moves the ball seat to a second seat location within the housing to place the assembly in an unlocked configuration, and shifting the mandrel to allow the retrieving head to move axially in the unlocked configuration.

Embodiment 2. The method of any prior embodiment, wherein the ball seat at the first seat location secures the mandrel in an extended position with respect to the housing when the assembly is in the locked configuration.

Embodiment 3. The method of any prior embodiment, wherein moving the ball seat from the first seat position releases the mandrel for movement.

Embodiment 4. The method of any prior embodiment, wherein the fluid pressure moves the ball seat to a second seat location at a ledge of the housing and elastically deforms the ball to pass the ball through the ball seat at the second seat location.

Embodiment 5. The method of any prior embodiment, wherein the ball seat at the second seat location allows axial motion between the retrieving head and the plug.

Embodiment 6. The method of any prior embodiment, further comprising moving the retrieving head axially with respect to the plug to shift the mandrel within the housing.

Embodiment 7. The method of any prior embodiment, wherein the lock further comprises a snap ring disposed in a groove of the housing when the ball seat is at the first seat location, further comprising moving the ball from the first seat location to collapse the snap ring radially out of the groove to allow a motion of the mandrel.

Embodiment 8. The method of any prior embodiment, wherein the ball seat maintains the mandrel in the first mandrel location by maintaining the snap ring in the groove.

Embodiment 9. An assembly for performing a downhole operation. The assembly includes a plug, and a retrieving head rigidly coupled to the plug in a locked configuration.

The retrieving head includes a lock disposed therein comprising a housing, a mandrel, and a ball seat. The ball seat is secured to the housing at a first seat location when the assembly is in the locked configuration. A ball seated at the ball seat causes a fluid pressure to increase at the ball to move the ball seat within the housing to place the assembly in an unlocked configuration that allows axial motion of the retrieving head. The mandrel is configured to shift within the housing to allow the retrieving head to rotate with respect to the plug in the unlocked configuration.

Embodiment 10. The assembly of any prior embodiment, wherein the ball seat at the first seat location secures the mandrel in an extended position with respect to the housing when the assembly is in the locked configuration.

Embodiment 11. The assembly of any prior embodiment, wherein the ball seat moves from the first seat position to release the mandrel for movement.

Embodiment 12. The assembly of any prior embodiment, wherein the fluid pressure moves the ball seat to a second seat location at a ledge of the housing and elastically deforms the ball to pass the ball through the ball seat at the second seat location.

Embodiment 13. The assembly of any prior embodiment, wherein the retrieving head is further configured to shift the mandrel within the housing.

Embodiment 14. The assembly of any prior embodiment, wherein the lock further comprises a snap ring disposed in a groove of the housing when the ball seat is at the first seat location, the lock configured to collapse radially inward when the ball seat moves from the first seat location to allow a motion of the mandrel.

Embodiment 15. The assembly of any prior embodiment, wherein, at the first seat location, the ball seat maintains the snap ring in the groove to maintain the mandrel in the first mandrel location.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of performing an operation in a borehole, comprising:

conveying an assembly in the borehole, the assembly including a retrieving head rigidly coupled to a plug in a locked configuration, the retrieving head including a lock disposed therein comprising a housing having a bore, a mandrel movable within the bore, a ball seat in the bore, and a snap ring, wherein the ball seat is secured to the housing at a first seat location when the assembly is in the locked configuration and the snap ring is disposed in a groove of the housing when the ball seat is at the first seat location, the snap ring wrapped around the ball seat and against a ridge of the mandrel to prevent axial motion of the mandrel;

dropping a ball through the assembly to seat at the ball seat, wherein a fluid pressure created at the ball moves the ball seat from the first seat location to a second seat location within the housing to place the assembly in an unlocked configuration, wherein moving the ball seat from the first seat location allows the snap ring to collapse radially inward and out of the groove to free the mandrel for movement within the housing; and shifting the mandrel to allow the retrieving head to move axially in the unlocked configuration.

2. The method of claim 1, wherein the ball seat at the first seat location secures the mandrel in an extended position with respect to the housing when the assembly is in the locked configuration.

3. The method of claim 2, wherein moving the ball seat from the first seat position releases the mandrel for movement.

4. The method of claim 1, wherein the ball seat at the second seat location allows axial motion between the retrieving head and the plug.

5. The method of claim 4, further comprising moving the retrieving head axially with respect to the plug to shift the mandrel within the housing.

6. The method of claim 1, wherein the ball seat maintains the mandrel in the first mandrel location by maintaining the snap ring in the groove.

7. An assembly for performing a downhole operation, comprising:

a plug; and a retrieving head rigidly coupled to the plug in a locked configuration, the retrieving head including a lock disposed therein comprising a housing having a bore, a mandrel movable within the bore, a ball seat in the bore secured to the housing at a first seat location via a snap ring disposed in a groove of the housing when the assembly is in the locked configuration, the snap ring being wrapped around a surface of the ball seat and against a ridge of the mandrel to prevent axial motion of the mandrel, wherein the ball seat is configured to receive a ball and to move within the housing due to an increase in a fluid pressure caused by the ball at the ball seat, thereby placing the assembly in an unlocked configuration that allows axial motion of the retrieving head, wherein movement of the ball seat from the first seat location allows the snap ring to collapse radially inward and out of the groove to free the mandrel for movement within the housing;

wherein the mandrel is configured to shift within the housing to allow the retrieving head to rotate with respect to the plug in the unlocked configuration.

8. The assembly of claim 7, wherein the ball seat at the first seat location secures the mandrel in an extended position with respect to the housing when the assembly is in the locked configuration.

9. The assembly of claim 8, wherein the ball seat is configured to move from the first seat location to release the mandrel for movement.

10. The assembly of claim 7, wherein the retrieving head is further configured to shift the mandrel within the housing.

11. The assembly of claim 7, wherein, at the first seat location, the ball seat maintains the snap ring in the groove to maintain the mandrel in the first mandrel location.

* * * * *